US009434170B1

(12) United States Patent
Komiya

(10) Patent No.: US 9,434,170 B1
(45) Date of Patent: Sep. 6, 2016

(54) PRINT DEVICE

(71) Applicant: BROTHER KOGYO KABUSHIKI KAISHA, Nagoya-shi, Aichi (JP)

(72) Inventor: Hidekazu Komiya, Nagoya (JP)

(73) Assignee: Brother Kogyo Kabushiki Kaisha, Nagoya-shi (JP)

( * ) Notice: Subject to any disclaimer, the term of this patent is extended or adjusted under 35 U.S.C. 154(b) by 0 days.

(21) Appl. No.: 15/060,739

(22) Filed: Mar. 4, 2016

(30) Foreign Application Priority Data

Mar. 6, 2015 (JP) ..... 2015-044465

(51) Int. Cl.
*B41J 2/165* (2006.01)

(52) U.S. Cl.
CPC ..... *B41J 2/16544* (2013.01); *B41J 2/16535* (2013.01); *B41J 2/16538* (2013.01)

(58) Field of Classification Search
CPC ..... B41J 2/16535; B41J 2/16538; B41J 2/16544
See application file for complete search history.

(56) References Cited

U.S. PATENT DOCUMENTS

2003/0007031 A1* 1/2003 Sugiyama ..... B41J 2/16532 347/33
2008/0286021 A1* 11/2008 Asami ..... B41J 2/16538 399/351

FOREIGN PATENT DOCUMENTS

JP 2007-076299 A 3/2007

* cited by examiner

*Primary Examiner* — Geoffrey Mruk
(74) *Attorney, Agent, or Firm* — Fox Rothschild LLP

(57) ABSTRACT

A print device includes a head portion, a wiper, a first wall portion, a pressing piece, a support member, and inserted members. The head portion has a nozzle face with a nozzle for discharging a liquid onto a print medium and moves in relation to the print medium. The wiper is provided between the first wall portion and the support member. The wiper is a plate-shaped elastic body and is opposed to the nozzle face. The pressing piece is provided in the first wall portion and presses against the wiper to maintain the wiper in a state of elastic deformation. The inserted members extend between the support member and the first wall portion and are inserted into a plurality of the holes formed in the wiper. The support member supports the wiper. The wiper wipes the nozzle face.

11 Claims, 9 Drawing Sheets

PRINT DEVICE

CROSS-REFERENCE TO RELATED APPLICATION

This application claims priority to Japanese Patent Application No. 2015-044465 filed on Mar. 6, 2015, the disclosure of which is herein incorporated by reference in its entirety.

BACKGROUND

The present disclosure relates to a printer with a wiper that removes ink that has adhered to a nozzle.

Liquid jetting devices are known that include a liquid jetting head, a wiper blade, a wiper blade holding member, and a wiper blade restricting member. The liquid jetting head emits liquid droplets (e.g., ink drops) from a nozzle formed on a nozzle face. The wiper plate has elasticity. The wiper blade comes into contact with the nozzle face formed in the liquid jetting head and wipes off any liquid (e.g., ink) that has adhered to the nozzle face. The wiper blade holding member is provided such that it holds the wiper blade upright. The wiper blade restricting member keeps the wiper blade in a deflected state. In the liquid jetting device, the wiping of the nozzle face with the wiper blade kept in the deflected state by the wiper blade restricting member prevents the liquid that has been wiped off by the wiper blade from splattering in the surrounding area.

SUMMARY

However, in a case where the wiper blade is affixed to the wiper blade holding member, for example, the load generated by the pressing force of the wiper blade restricting member on the wiper blade and the load generated by the impact of the wiper blade coming into contact with the nozzle face both bear directly on the wiper blade. Because the loads bear directly on the wiper blade, the load on the wiper blade increases. When the load on the wiper blade increases, damage to the wiper blade, such as cracking and the like, occurs sooner and makes it impossible for the wiper blade to adequately remove the liquid from the nozzle face. That may cause maintenance problems in the liquid jetting head.

Various embodiments of the general principles described herein provide a printer that is able to reduce a load on a wiper and thus reduce maintenance problems in a head.

Embodiments herein provide a print device including a head portion, a wiper, a first wall portion, at least one pressing piece, a support member, and a plurality of inserted members. The head portion includes a nozzle face. The nozzle face has a nozzle. The nozzle is provided to discharge a liquid onto a print medium. The head portion is able to move in relation to the print medium in at least a first direction among parallel directions to the nozzle face. The wiper is a plate-shaped elastic body and extends in a second direction. The second direction is orthogonal to the first direction and parallel to the nozzle face. The wiper includes a plurality of holes. The plurality of holes extend through the wiper in the first direction. The wiper includes a wiper edge portion. The wiper edge portion is opposed to the nozzle face and provided on an edge portion of the wiper to wipe the nozzle face. The first wall portion is provided on the opposite side of the wiper from the first direction side and is provided on a third direction from the wiper edge portion. The third direction is a direction from the nozzle face toward the wiper of orthogonal directions in relation to the nozzle face. The at least one pressing piece is provided in the first wall portion and extends toward the wiper. The at least one pressing piece presses against the wiper at a position in the third direction from the wiper edge portion to maintain the wiper in a state of elastic deformation. The support member is provided on the first direction side of the wiper and supporting the wiper. The plurality of inserted members are provided on the third direction from the at least one pressing piece and extend in the first direction between the support member and the first wall portion. The plurality of the inserted members are inserted into the plurality of the holes respectively.

BRIEF DESCRIPTION OF THE DRAWINGS

Embodiments will be described below in detail with reference to the accompanying drawings in which.

DETAILED DESCRIPTION

Figure 1:
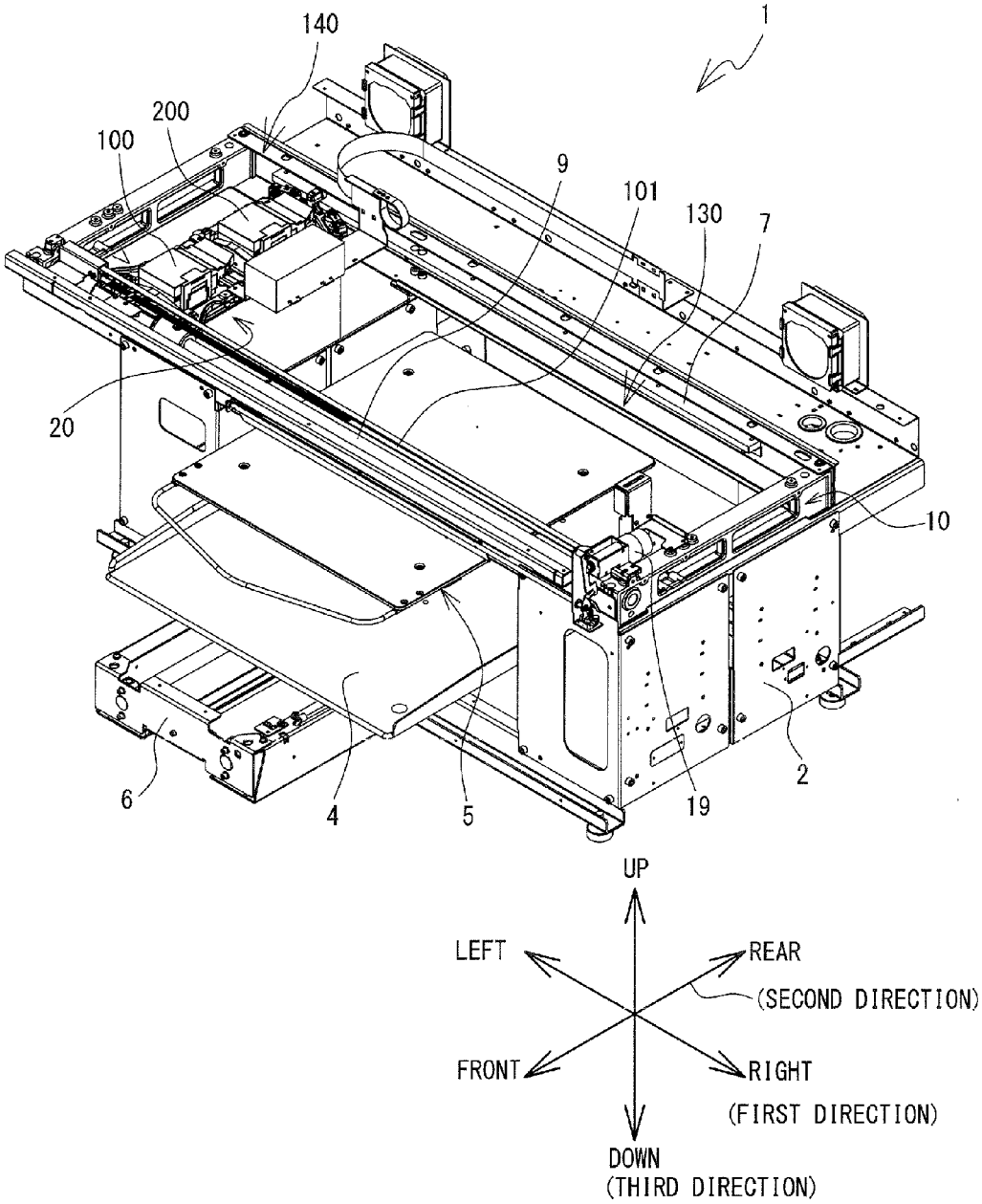
FIG. 1 is an oblique view of a printer 1.

The drawings that are hereinafter referenced are used for explaining technological features that the present disclosure can utilize. Device configurations and the like that are shown in the drawings are merely explanatory examples and do not serve to restrict the present disclosure to those configurations and the like. In the explanation that follows, the top side, the bottom side, the lower left side, the upper right side, the lower right side, and the upper left side in FIG. 1 respectively define the top side, the bottom side, the front side, the rear side, the right side, and the left side of a printer 1. Note that the rightward direction will also be called the first direction. The front-rear direction will also be called the second direction. The downward direction will also be called the third direction.

The printer 1 will be explained with reference to FIGS. 1 to 9. The printer 1 is an inkjet printer that, by discharging a liquid ink, performs printing on a cloth (not shown in the drawings), such as a T-shirt or the like, that is a print medium. The printer 1 may also use paper or the like as the print medium. The printer 1 is able to print a color image on the print medium by discharging five different types of the ink (white (W), black (K), yellow (Y), cyan (C), and magenta (M)) downward. Each of the inks is made from a solvent that is either water or an organic solvent, for example, plus a colored pigment or dye. The ink may also contain a resin emulsion. The resin emulsion is included in the ink as a dispersant for the pigment, for example, or as a binder that fixes the pigment to the cloth. An ink that contains a resin emulsion tends to have a greater viscosity than an ink that does not contain a resin emulsion. Furthermore, when an ink that contains a resin emulsion dries, its viscosity becomes even greater, so if the ink falls onto a member or the like and dries, it may harden and bind to the member or the like.

As shown in FIG. 1, the printer 1 is provided with a housing 2, a frame body 10, a guide shaft 9, a rail 7, a carriage 20, head units 100, 200, a drive belt 101, a drive motor 19, a platen drive mechanism 6, a platen 5, and a tray 4.

An operation portion (not shown in the drawings) that performs operations of the printer 1 is provided on the right front side of the housing 2. The operation portion is provided with a display and an operation button.

The frame body 10 is disposed in the top portion of the housing 2. The frame body 10 is a substantially rectangular frame body in a plan view. The front side of the frame body 10 supports the guide shaft 9, and the rear side of the frame body 10 supports the rail 7 through the housing 2. The guide shaft 9 extends from left to right on the inner side of the frame body 10. The rail 7 extends from left to right, and it is disposed opposite the guide shaft 9.

Figure 3:
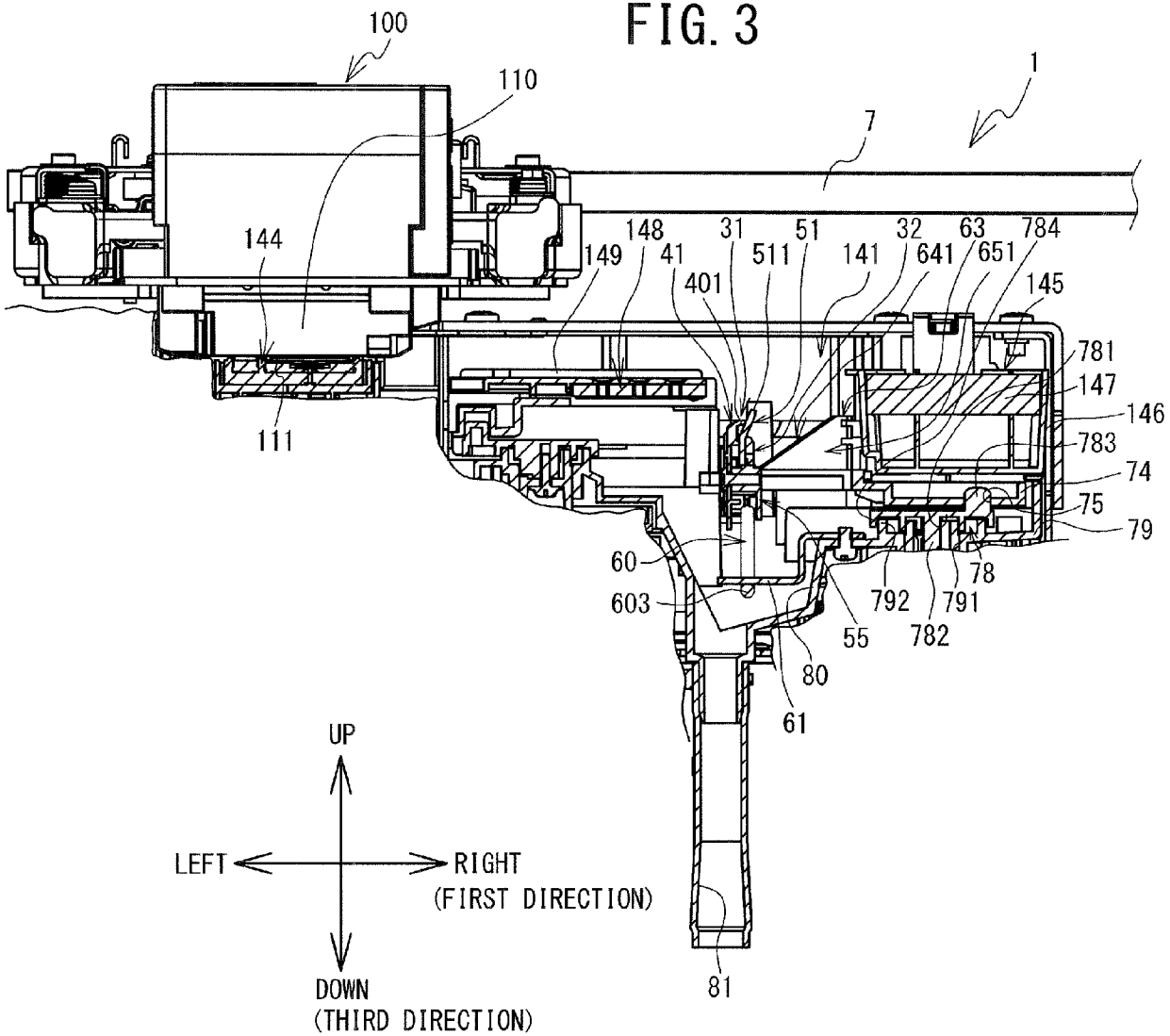
FIG. 3 is a section view from the direction of arrows on a line III-III in FIG. 2, with a wiper portion 31 in a withdrawn position.
Figure 4:
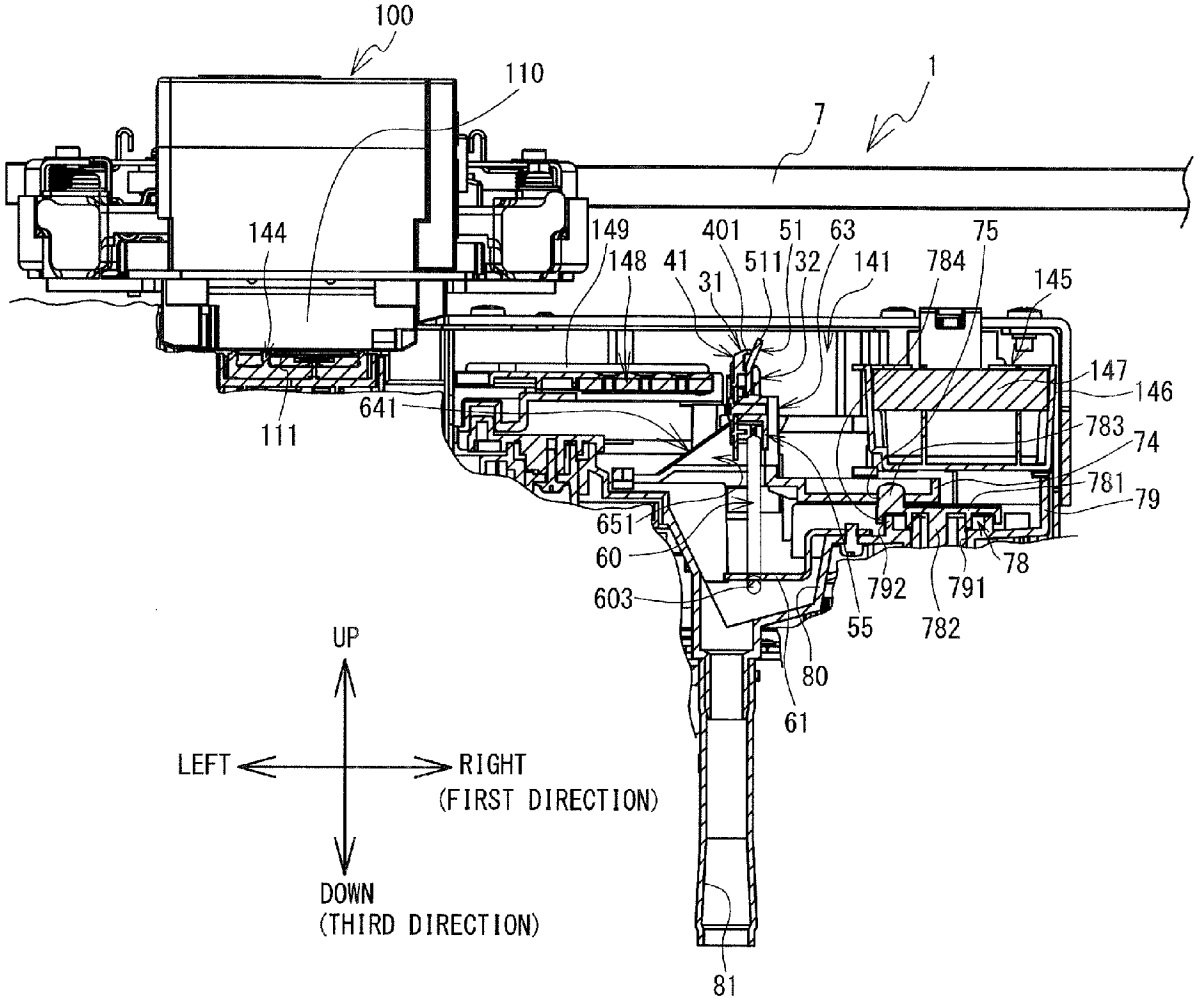
FIG. 4 is a figure that shows the wiper portion 31 in a state in which it is in a contact position in the section view in FIG. 3.
Figure 5:
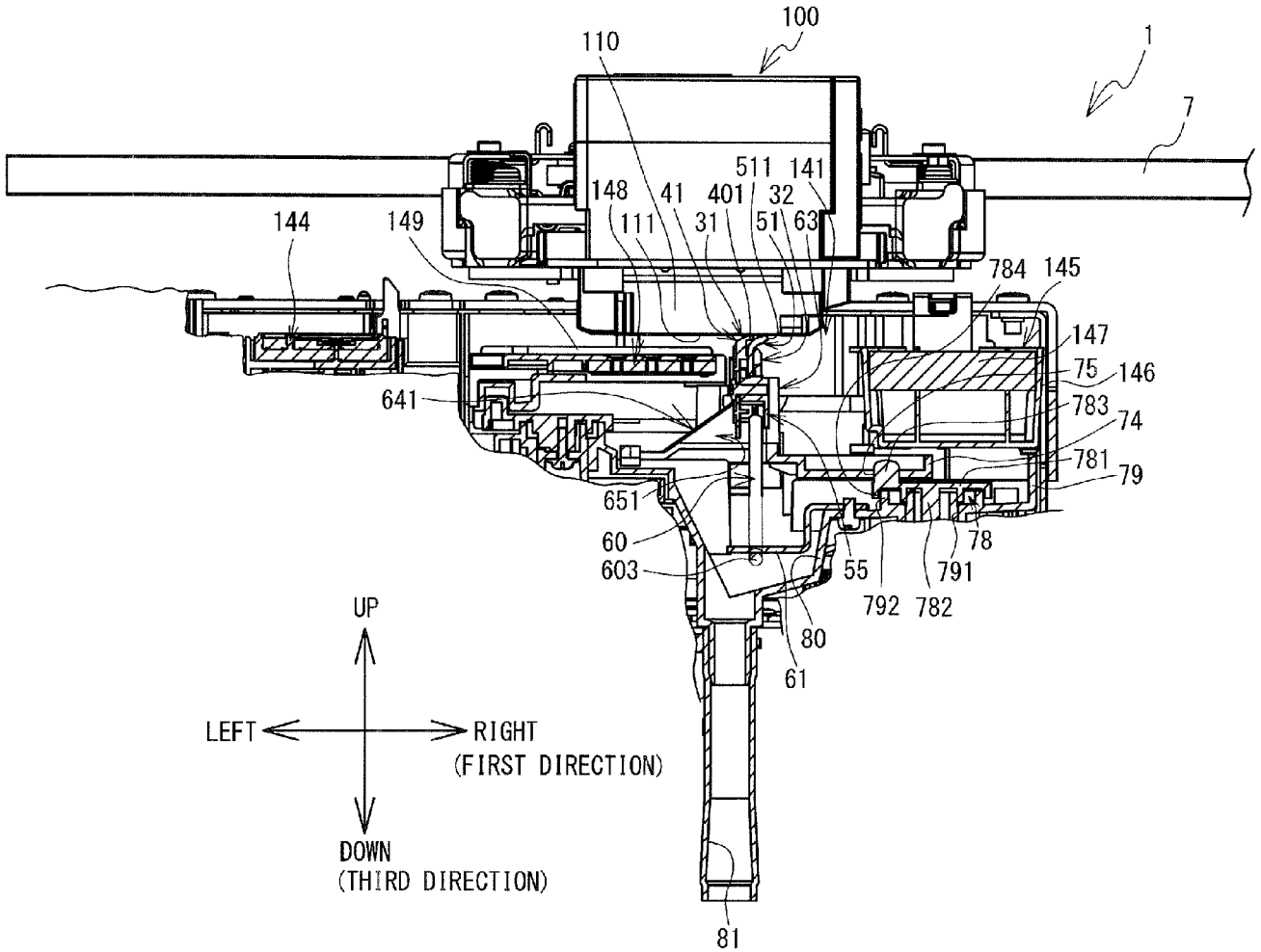
FIG. 5 is a figure that shows a state in which a first wiping operation is in progress in the section view in FIG. 3.

The carriage 20 is disposed on the inner side of the frame body 10. The carriage 20 is supported such that it can be conveyed to the left and the right along the guide shaft 9. The head units 100, 200 are carried on the carriage 20 and are arrayed in the front-rear direction. The head unit 100 is disposed in front of the head unit 200. As shown in FIGS. 3 to 5, a head 110 is provided on the bottom of each one of the head units 100, 200. A nozzle face 111 that is flat and parallel to the front-rear direction and the left-right direction is formed on the bottom face of the each of the heads 110. FIGS. 3 to 5 show the head 110 and the nozzle face 111 on the head unit 100. A plurality of tiny nozzles are provided in the nozzle face 111 that are able to discharge the ink downward.

As shown in FIG. 1, the drive belt 101 spans the inner side of the frame body 10 from left to right. The drive motor 19 is provided in the front right portion of the inner side of the frame body 10. The drive motor 19 is coupled to the carriage 20 through the drive belt 101.

The platen drive mechanism 6 is disposed in the lower part of the printer 1, in the center in the left-right direction. The platen drive mechanism 6 is provided with a pair of guide rails (not shown in the drawings) and a platen support base (not shown in the drawings). The pair of the guide rails extend from the front to the rear on the inner side of the platen drive mechanism 6. The pair of the guide rails support the platen support base such that it can move toward the front and the rear. The platen support base supports the platen 5 above the tray 4, which is described below. The platen 5 supports the print medium.

The tray 4 is disposed below the platen 5. When the user places a shirt, for example, as the print medium on the platen 5, the tray 4 receives the sleeves of the shirt. The sleeves are therefore protected, such that they do not come into contact with other parts in the interior of the housing 2.

According to the above described configuration, when the drive motor 19 drives the drive belt 101, the carriage 20 on which the head units 100, 200 are carried is moved reciprocally along the guide shaft 9 in the first direction and in the opposite direction from the first direction. The head units 100, 200 move between the left end and the right end of the inner side of the frame body 10. At this time, the platen drive mechanism 6 moves the platen support base and the platen 5 in the front-rear direction along the pair of the guide rails. The drive source for the platen drive mechanism 6 is a motor (not shown in the drawings) that is provided at the rear edge of the platen drive mechanism 6. The printer 1 performs printing on the print medium by conveying the print medium supported by the platen 5 in the front-rear direction and discharging the ink onto the print medium from the plurality of the nozzles provided in the head units 100, 200, which move reciprocally in the left-right direction. Note that the front-rear direction is a conveyance direction and an auxiliary scanning direction, and the left-right direction is a main scanning direction.

Figure 2:
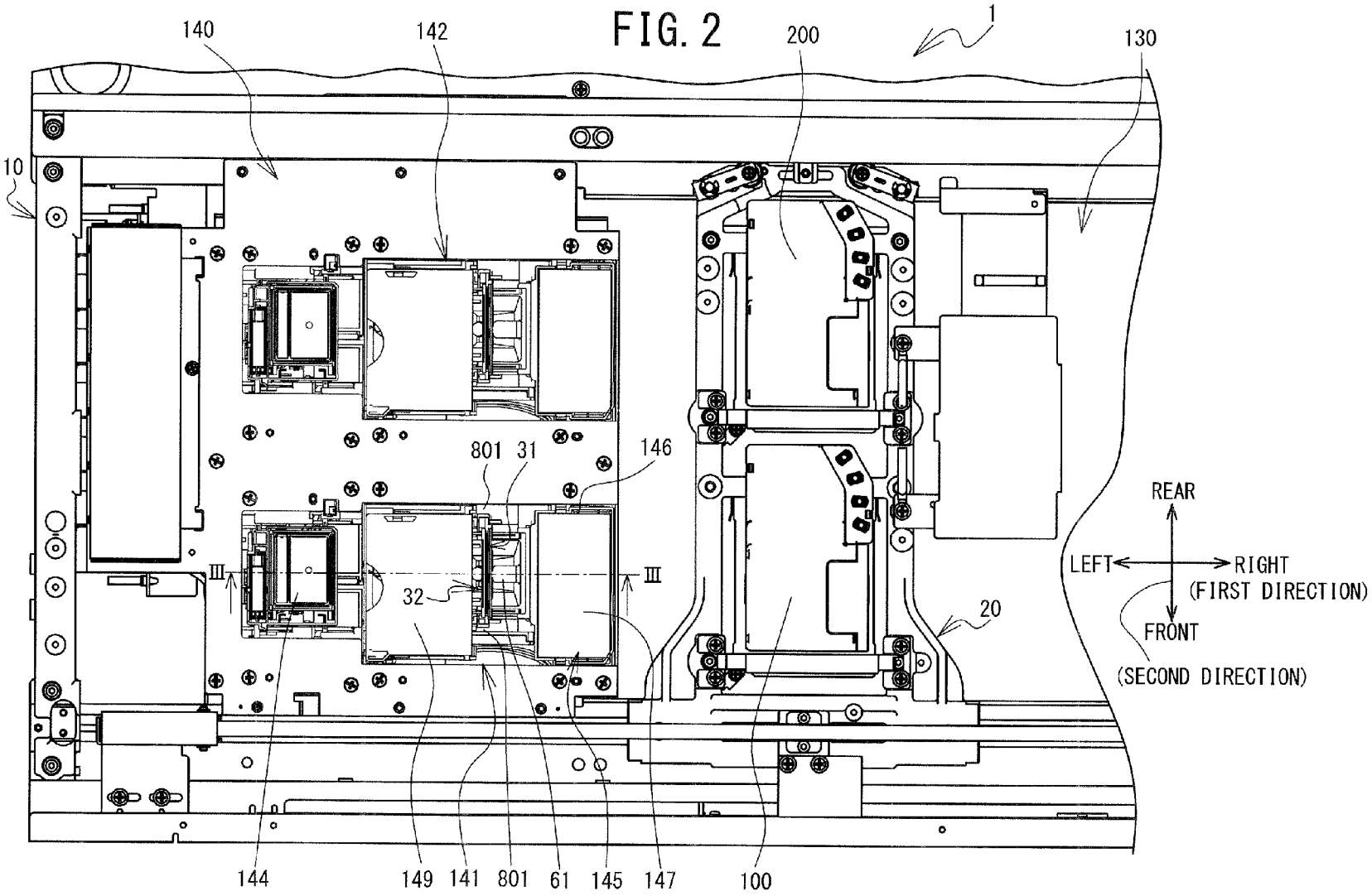
FIG. 2 is a plan view of the printer 1.

As shown in FIGS. 1 and 2, along the paths that the head units 100, 200 travel, the area where the printing is performed by the head units 100, 200 will be called the printing area 130. The area along the paths that the head units 100, 200 travel that is not in the printing area 130 will be called the non-printing area 140. The non-printing area 140 is an area in the left portion of the printer 1. The printing area 130 is the area from the right edge of the non-printing area 140 to the right end of the printer 1. As shown in FIG. 1, the platen 5, the tray 4, and the like are provided in the printing area 130.

As shown in FIG. 2, maintenance portions 141, 142 are provided in the non-printing area 140. The maintenance portions 141, 142 are provided below the travel paths of the head units 100, 200, respectively. In the maintenance portions 141, 142, maintenance operations are performed on the head units 100, 200 under the control of a CPU (not shown in the drawings) of the printer 1. The maintenance operations will be described in detail later. The configurations of the maintenance portions 141, 142 are almost identical. Therefore, an explanation of the maintenance portion 142 will be omitted, and in the explanation that follows, the maintenance portion 141 will be explained.

As shown in FIGS. 3 to 5, the maintenance portion 141 is provided with a nozzle cap 144, a flushing receiving portion 145, an absorption member 148, a support plate 149, a wiper portion 31, a second spring support portion 61, a pair of guide wall portions 801 (refer to FIG. 2), a movement portion 63, and a rotary member 78. The nozzle cap 144 is provided in the left portion of the maintenance portion 141. The nozzle cap 144 is a cap that is rectangular in a plan view and is open at the top. The nozzle cap 144 can move up and down.

The flushing receiving portion 145 is positioned in the right part of the maintenance portion 141 and above a wall portion 74 of the movement portion 63, which will be described later. The flushing receiving portion 145 is provided with a container portion 146 and an absorption body 147. The container portion 146 is a container that is rectangular in a plan view and is open at the top. The absorption body 147 is disposed inside the container portion 146. The absorption body 147 is a rectangular parallelepiped member that can absorb the ink. The flushing receiving portion 145 receives the ink that has been discharged from the head unit 100 by the flushing operation, which will be described later. The ink that the flushing receiving portion 145 has received is absorbed by the absorption body 147.

The support plate 149 is provided between the wiper portion 31 and the nozzle cap 144 in the left-right direction. The support plate 149 is a horizontally extending plate-shaped member that is rectangular in a plan view. The support plate 149 is moved to the left and the right by a drive mechanism that is not shown in the drawings. The absorption member 148 is attached to the bottom face of the support plate 149. The absorption member 148 is plate-shaped and extends horizontally. By moving to the left and the right in relation to the wiper portion 31, the absorption member 148 slides along an upper edge (hereinafter called the wiper edge portion 511) of a wiper 51 and removes the ink from the wiper edge portion 511.

Figure 6:
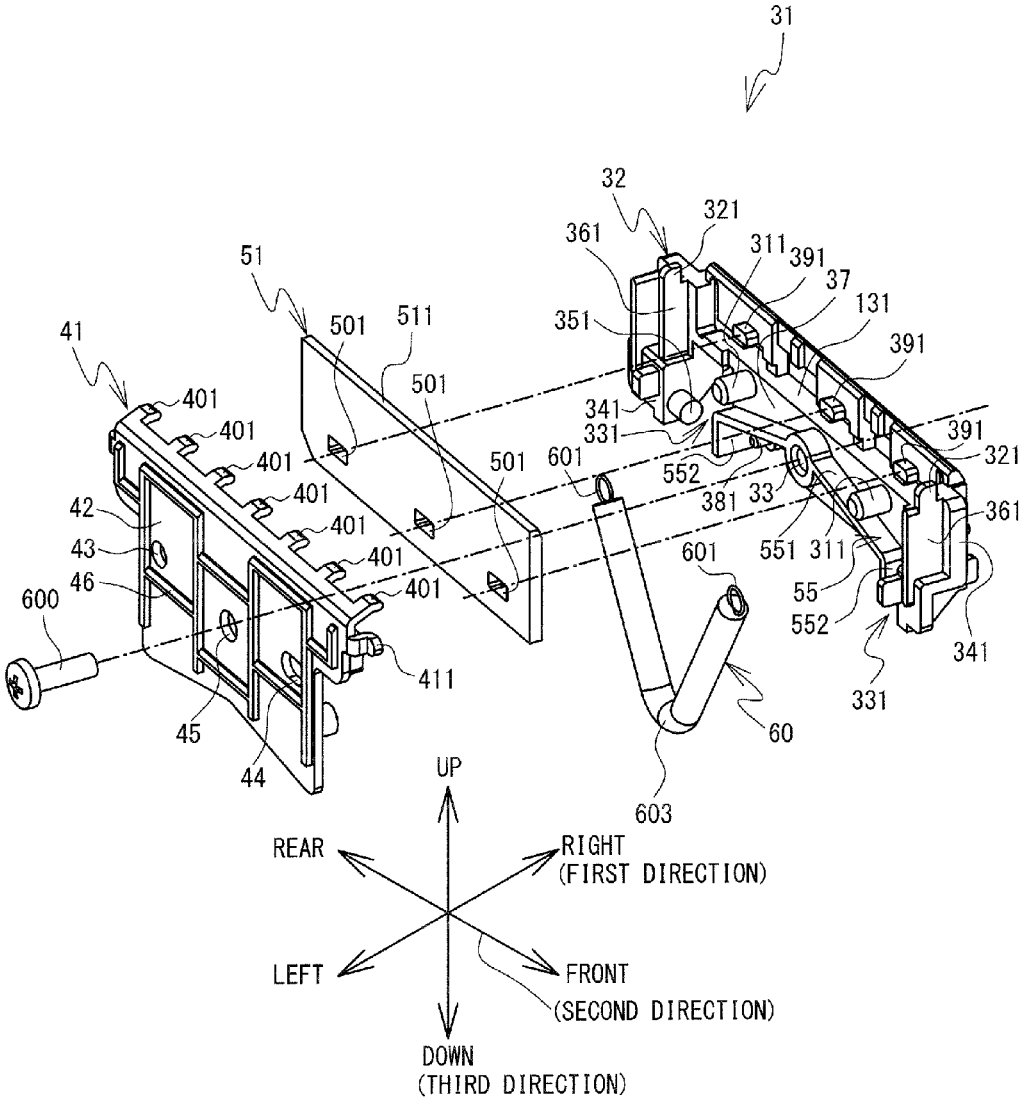
FIG. 6 is an exploded view of the wiper portion 31.

As shown in FIGS. 3 to 5, the wiper portion 31 is disposed to the left of the flushing receiving portion 145 and is positioned lower than the nozzle face 111. As shown in FIG. 6, the wiper portion 31 is provided with the wiper 51, a support member 32, a plurality of inserted members 391, a restricting member 41, a coil spring 60, and a protective member 55. The wiper 51 is a plate-shaped elastic body that extends in the second direction. The wiper edge portion 511 and the nozzle face 111 are disposed opposite to each other in the up-down direction (refer to FIGS. 3 to 5). In the lower part of the wiper 51, a plurality of holes 501 are formed that extend through the wiper 51 in the first direction and are arrayed in the front-rear direction. In the present embodiment, the plurality of the holes 501 are three in number. Each one of the plurality of the holes 501 is substantially rectangular in a side view. When the wiper edge portion 511 comes into contact with the nozzle face 111, the wiper 51 can wipe off any of the ink that has adhered to the nozzle face 111.

The support member 32 is provided on the first direction side of the wiper 51. In a side view, the support member 32 has a rectangular shape whose long axis extends in the front-rear direction, and it has a specified thickness in the left-right direction. The support member 32 is provided with a recessed portion 131 that is recessed downward from the top face of the support member 32. The support member 32 supports the wiper 51 on the inner side of the recessed portion 131.

A pair of recessed portions 331 are provided in the lower edge of the support member 32 near the front and rear ends of the support member 32. The pair of the recessed portions 331 are recessed upward and extend through the support member 32 in the left-right direction. An arm 341 is formed in front of the recessed portion 331 near the front end, and another arm 341 is formed to the rear of the recessed portion 331 near the rear end. An engaging lug 351 that projects toward the recessed portion 331 is provided on the lower end of each one of the pair of the arms 341. A plate-shaped guide 361 that extends to the left is provided on each one of the pair of the arms 341. An engaged portion 321 that extends upward is provided on the upper end of each one of the pair of the guides 361.

A wall portion 37 is formed that spans the distance from the recessed portion 331 near the front end to the recessed portion 331 near the rear end. The wall portion 37 extends in the front-rear direction and the up-down direction. A first spring support portion 381 is provided at each one of the front end and the rear end of the lower edge of the wall portion 37. That is, the pair of the first spring support portions 381 are set apart from one another in the front-rear direction. The first spring support portions 381 project toward the left from the wall portion 37. A lug 311 is provided on the wall portion 37 above each one of the pair of the first spring support portions 381. The lugs 311 are substantially columnar that project toward the left. A threaded anchoring hole 33 is provided in a central portion of the front-rear direction of the wall portion 37. The threaded anchoring hole 33 is cylindrical that projects toward the left.

In the present embodiment, the plurality of the inserted members 391 are three in number. The plurality of the inserted members 391 are provided close to the upper edge of the support member 32, in positions that correspond to the three holes 501 in the wiper 51. Each one of the plurality of the inserted members 391 extends in the opposite direction from the first direction. The plurality of the inserted members 391 are substantially square columnar. The cross-sectional areas of the plurality of the inserted members 391 in the front-rear and up-down directions are smaller than those of the plurality of the holes 501 in the wiper 51. Thus, in a case where the plurality of the inserted members 391 have been inserted into the plurality of the holes 501 in the wiper 51, small gaps exist between the inserted members 391 and the corresponding holes 501. Therefore, in a case where the plurality of the inserted members 391 have been inserted into the plurality of the holes 501 in the wiper 51, the wiper 51 can move in relation to the plurality of the inserted members 391.

The restricting member 41 is provided on the left side of the wiper 51.

The restricting member 41 is provided with a first wall portion 42 and a plurality of pressing pieces 401. The first wall portion 42 is a plate-shaped member that extends farther in the third direction than the wiper edge portion 511. More specifically, the edge on the third direction side of the first wall portion 42 is formed such that it slopes from the center of the edge in the second direction toward the ends of the edge in the second direction, such that the ends of the edge in the second direction are positioned lower than the center of the edge in the second direction.

The first wall portion 42 includes a round hole 43, an oblong hole 44, an anchoring hole 45, a pair of engaging portions 411, and ribs 46. The round hole 43 extends through the first wall portion 42 close to the rear edge, approximately midway between the top and the bottom of the first wall portion 42. The round hole 43 corresponds to the one of the pair of the lugs 311 that is positioned closer to the rear. The lug 311 is inserted into the round hole 43 from the right side. The oblong hole 44 extends through the first wall portion 42 in the left-right direction close to the front edge, approximately midway between the top and the bottom of the first wall portion 42. The oblong hole 44 corresponds to the one of the pair of the lugs 311 that is positioned closer to the front. The long axis of the oblong hole 44 extends in the front-rear direction, and the lug 311 is inserted into the oblong hole 44 from the right side. The anchoring hole 45 extends through the first wall portion 42 in the left-right direction, approximately in the center of the first wall portion 42. The anchoring hole 45 corresponds to the threaded anchoring hole 33.

A screw 600 is inserted into the anchoring hole 45 from the left side and is screwed into the threaded anchoring hole 33. The pair of the engaging portions 411, located close to the upper edge of the first wall portion 42, are hook-shaped in a plan view and project toward the right from the front and rear edges of the first wall portion 42. The pair of the engaging portions 411 engage with the corresponding right sides of the pair of the engaged portions 321. In other words, the restricting member 41 and the support member 32 are anchored to one another by the lugs 311 that are inserted into the round hole 43 and the oblong hole 44, by the screw 600 that is inserted into the anchoring hole 45 and screwed into the threaded anchoring hole 33, and by the engaging portions 411 that engage with the engaged portions 321. The ribs 46 are provided over the entire left side of the first wall portion 42, extending in both the up-down direction and the front-rear direction and projecting slightly toward the left. The ribs 46 reinforce the first wall portion 42.

The plurality of the pressing pieces 401 are seven members that extend in the first direction toward the wiper 51 from the edge on the opposite side from the third direction side of the first wall portion 42 (that is, the upper edge). Each one of the plurality of the pressing pieces 401 is substantially rectangular in a plan view. The plurality of the pressing pieces 401 are disposed such that they are arrayed in the second direction, with each one of the pressing pieces 401 being set apart from the neighboring pressing pieces 401. By pressing against the left side face of the wiper 51, with the plurality of the pressing pieces 401 positioned to the third direction side of the wiper edge portion 511, the restricting member 41 maintains the wiper 51 in a state of being elastically deformed in the first direction.

The coil spring 60 is provided on the third direction side of the plurality of the pressing pieces 401, closer to the center in the second direction of the restricting member 41 than the ends of the restricting member 41 in the second direction. A ring-shaped spring end portion 601 is provided on each end of the coil spring 60. Only one of the first spring support portions 381 is shown in FIG. 6, but the other one of the first spring support portions 381 is formed in the support member 32 and positioned symmetrically in the front-rear direction in relation to the first spring support portion 381 that is shown. The coil spring 60 is supported by hooking the spring end portions 601 to the corresponding first spring support portions 381. With the spring end portions 601 supported by the first spring support portions 381, a central portion 603 of the coil spring 60 is pulled downward and hooked to the bottom face of the second spring support portion 61 (refer to FIGS. 3 to 5), which will be described later. In other words, the coil spring 60 is supported at the three points of the second spring support portion 61 and the pair of the first spring support portions 381, so the coil spring 60 assumes a V shape, with the central portion 603 pointing downward, as shown in FIG. 6. By energizing the support member 32 in the third direction, the coil spring 60 energizes the wiper portion 31 downward.

Figure 7:
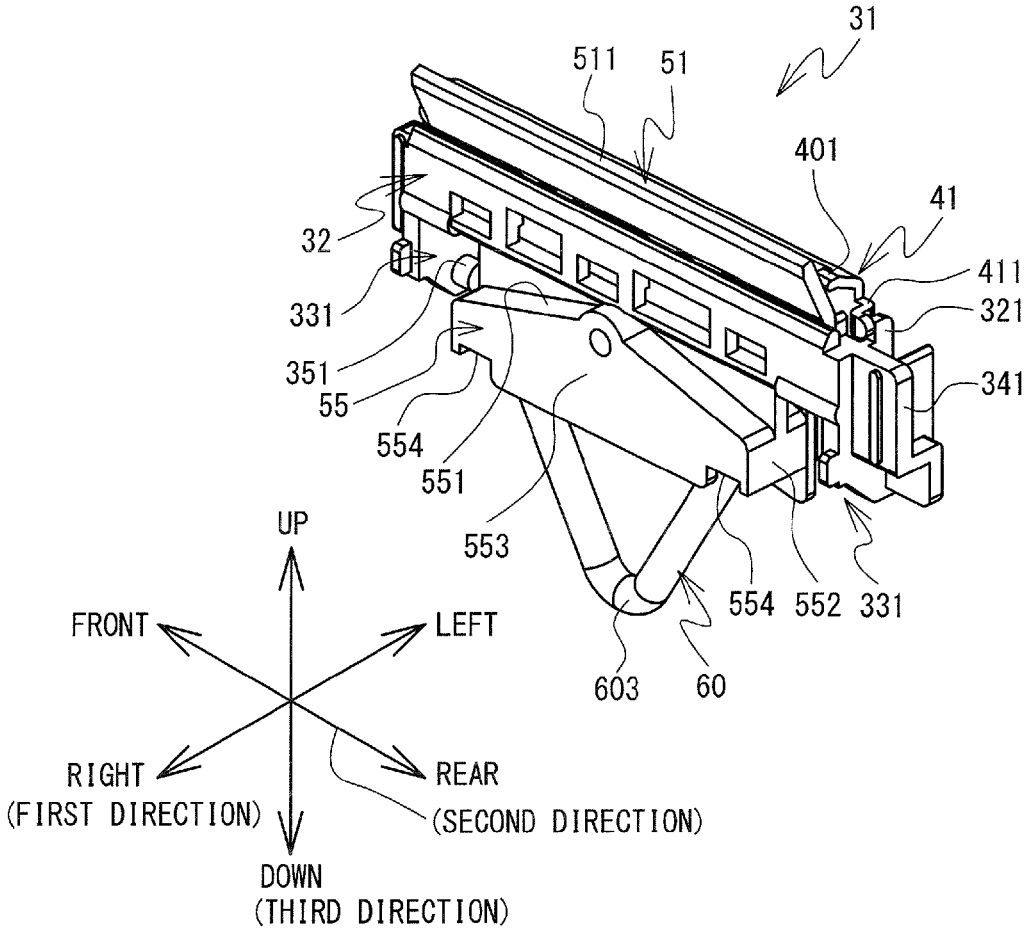
FIG. 7 is an oblique view of the wiper portion 31.

As shown in FIGS. 6 and 7, the protective member 55 is provided on the lower part of the support member 32. The protective member 55 is formed by a top wall 551, a pair of side walls 552, and a second wall portion 553 (refer to FIG. 7). The top wall 551 is provided lower than the plurality of the pressing pieces 401 and above the coil spring 60. That is, the top wall 551 covers the coil spring 60 from the nozzle face 111 side (refer to FIGS. 3 to 5). More specifically, the top wall 551 slopes in the third direction from the center portion in the second direction of the top wall 551 toward both ends in the second direction of the top wall 551. The lower edge of the support member 32 is connected to the top face of the top wall 551. The pair of the side walls 552 extend in the third direction from both ends in the second direction of the top wall 551. As shown in FIG. 7, the second wall portion 553 is provided on the first direction side from the coil spring 60. The second wall portion 553 extends in the third direction from the first direction edge of the top wall 551. The second wall portion 553 is provided with a pair of slots 554 on the third direction edge of the second wall portion 553, slightly inside from the second direction ends of the second wall portion 553. The slots 554 are substantially rectangular in a side view and extend in the opposite direction from the third direction.

As shown in FIGS. 3 to 5, the second spring support portion 61 is positioned below the support member 32 in the up-down direction and between the pair of the spring end portions 601 (refer to FIG. 6) in the front-rear direction. The right end of the second spring support portion 61 is supported by the left part of a wall portion 79 that will be described later. The second spring support portion 61 is a metal plate that extends to the left from the position where it is supported by the wall portion 79, bends downward, and then bends to the left.

Figure 8:
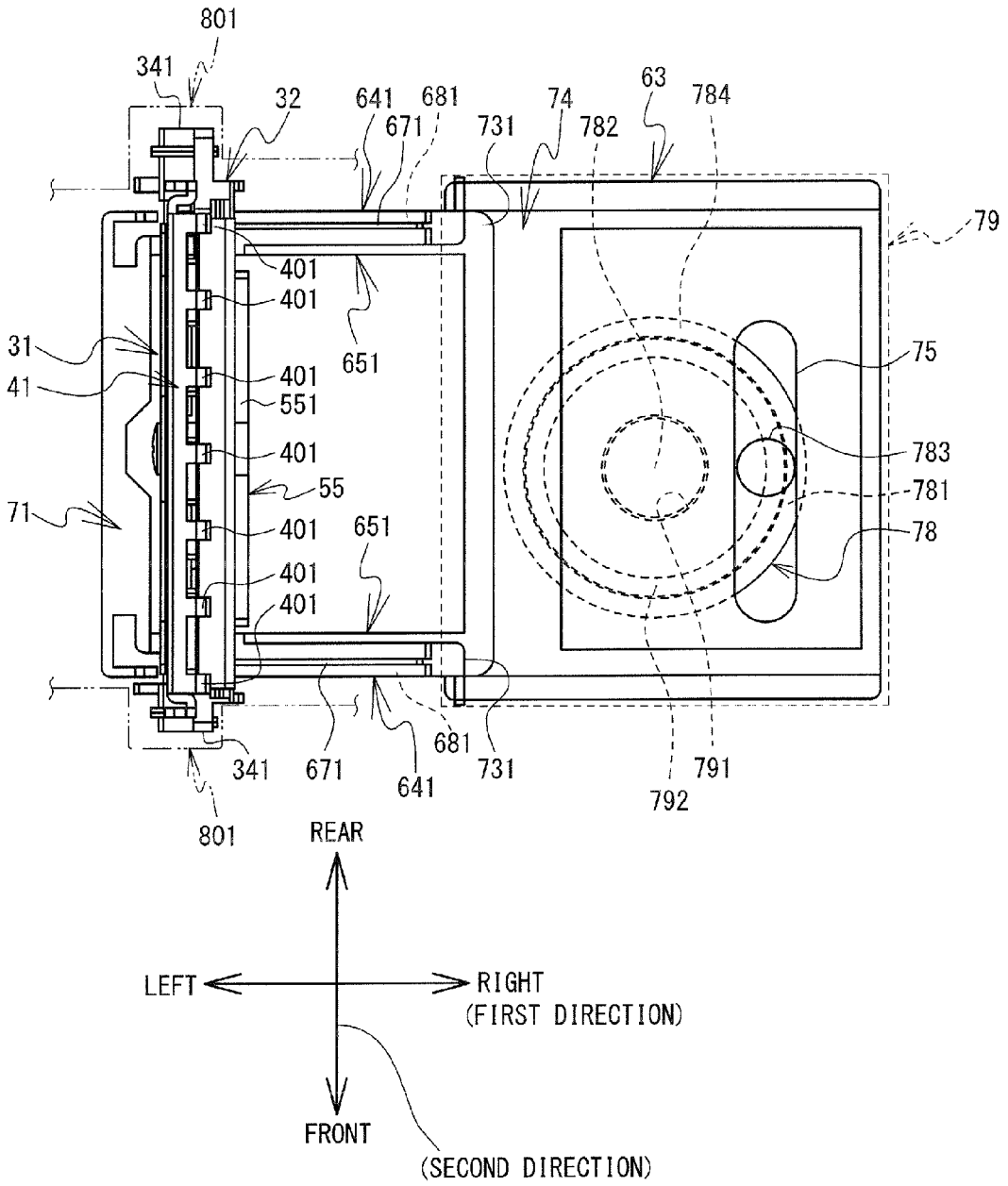
FIG. 8 is a plan view of the wiper portion 31 and a movement portion 63.

As shown in FIG. 8, the pair of the guide wall portions 801 extend in the up-down direction and are formed around the perimeters of the arms 341 of the support member 32 in a plan view. The guide wall portions 801 form a pair of wall faces that flank and face the arms 341 on the left and the right. The guide wall portions 801 restrict the movement of the support member 32 to the left and the right.

Figure 9:
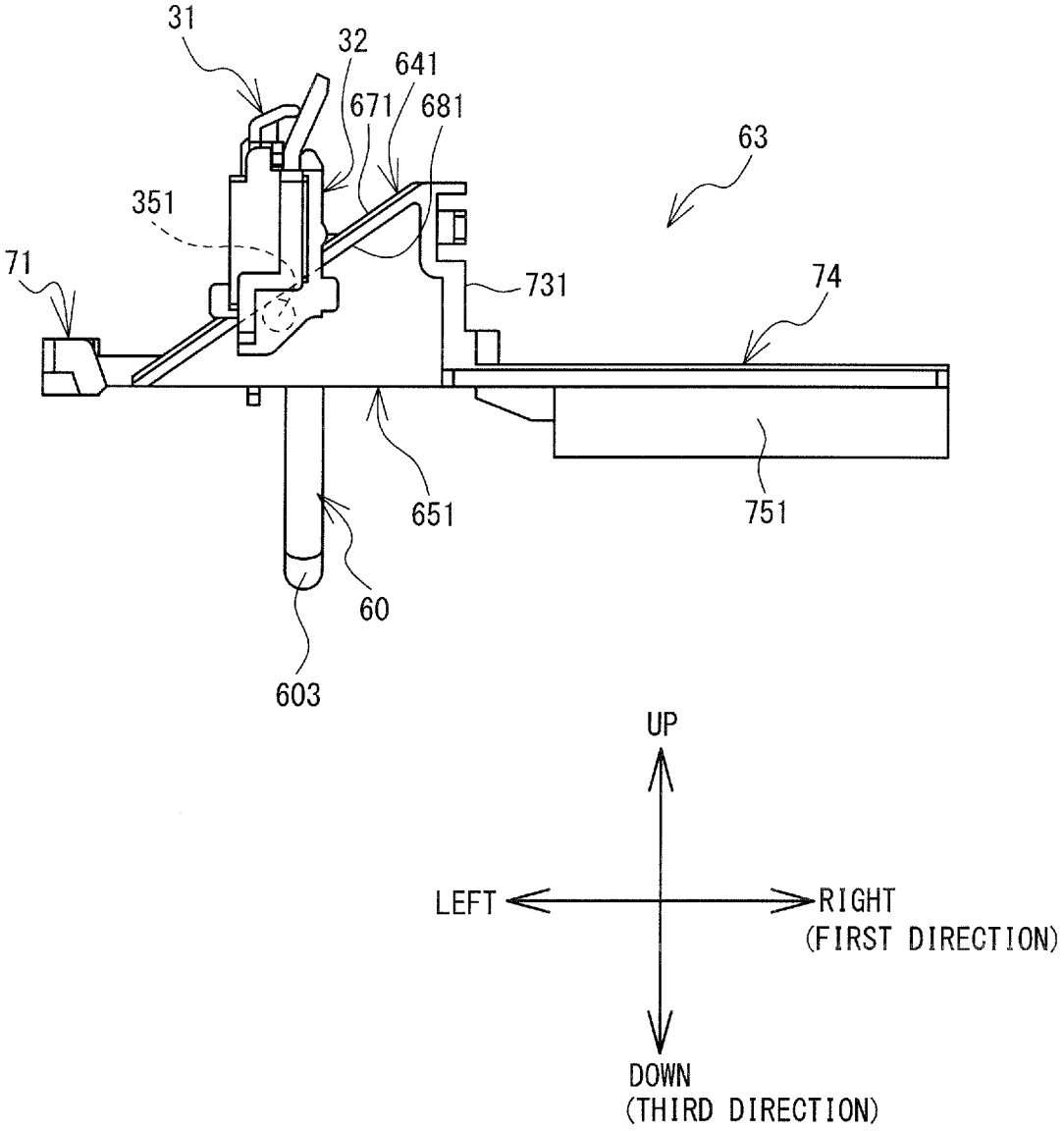
FIG. 9 is a front view of the wiper portion 31 and the movement portion 63.

As shown in FIGS. 3 to 5, the movement portion 63 is disposed to the right of the wiper portion 31. The movement portion 63 performs an operation that moves the wiper portion 31 to a withdrawn position (refer to FIG. 3), in accordance with the energizing force of the coil spring 60 in the third direction. The movement portion 63 also performs an operation that moves the wiper portion 31 to a contact position (refer to FIG. 4), against the energizing force of the coil spring 60 in the third direction. As shown in FIG. 3, the withdrawn position is a position where the wiper edge portion 511 of the wiper 51 is lower than the nozzle face 111. In other words, in the withdrawn position, the wiper portion 31 is not able to come into contact with the nozzle face 111, even if the head unit 100 moves in the left-right direction. As shown in FIG. 4, the contact position is a position where the wiper edge portion 511 of the wiper 51 is higher than the nozzle face 111. In other words, when the wiper portion 31 is in the contact position, the wiper 51 can be brought into contact with the nozzle face 111 by the moving of the head unit 100 in the left-right direction. A mechanism that moves the wiper portion 31 up and down between the withdrawn position and the contact position will be described in detail later. As shown in FIGS. 8 and 9, the movement portion 63 is provided with a pair of opposing wall portions 651, an extension portion 71, and the wall portion 74. The pair of the opposing wall portions 651 are opposite one another in the front-rear direction. Each of the opposing wall portions 651 is substantially triangular in a front view. Each of the opposing wall portions 651 can be elastically deformed toward the front and the rear. Each of the opposing wall portions 651 is provided with a sloping portion 641, a contact portion 671, an engagement portion 681, and an extended wall portion 731.

The pair of the sloping portions 641 are opposite one another in the front-rear direction and are positioned below the support member 32. The sloping portions 641 are formed on the tops of the opposing wall portions 651 and extend obliquely downward to the left. The edge portions on the outer sides of the pair of the sloping portions 641 in the front-rear direction are each plate-shaped and project toward the outside in the front-rear direction.

Each of the contact portions 671 projects upward from the top face of the sloping portion 641 in the center of the front-rear direction of the sloping portion 641. The contact portions 671 extend obliquely downward to the left along the sloping portions 641. Each of the engagement portions 681 is recessed toward the inside on the outer side face of the sloping portion 641 in the front-rear direction. The engagement portions 681 extend obliquely downward to the left along the sloping portions 641.

The engagement portions 681 engage with the corresponding engaging lugs 351 of the support member 32 (refer to FIGS. 6, 7, and 9). At that time, the sloping portions 641 are disposed in the corresponding recessed portions 331 of the support member 32 (refer to FIGS. 6 and 7). The contact portions 671 come into contact with the top faces of the corresponding recessed portions 331.

The extended wall portions 731, which extend in the up-down direction, are formed on the right edges of the opposing wall portions 651. The upper ends of the extended wall portions 731 are connected to the upper ends of the sloping portions 641.

The extension portion 71 spans the distance between the lower edges of the pair of the opposing wall portions 651. The extension portion 71 has a plate shape extending in both the front-rear direction and the left-right direction and can flex upward and downward.

As shown in FIGS. 3 to 5 and FIG. 8, the wall portion 74 is rectangular in a plan view and extends horizontally. The left parts of both the front and rear edges of the wall portion 74 are connected to the lower ends of the extended wall portions 731. An oblong hole 75 is provided in the right part of the wall portion 74. The oblong hole 75 extends through the wall portion 74 in the up-down direction, and its long axis extends in the front-rear direction. As shown in FIG. 9, wall portions 751 that project downward from the wall portion 74 are provided on both edges of the wall portion 74 in the front-rear direction. The wall portions 751 are disposed to the inner side, in the front-rear direction, of the wall portion 79 (refer to FIGS. 3 to 5 and FIG. 8), which will be described later, and to the inner side of a recessed portion (not shown in the drawings) that extends in the left-right direction.

As shown in FIGS. 3 to 5 and FIG. 8, the rotary member 78 is disposed below the wall portion 74. The rotary member 78 is provided with a wall portion 781, a drive shaft 782, a shaft portion 783, and a wall portion 784. The wall portion 781 faces the wall portion 74 on the underside of the wall portion 74. The wall portion 781 is circular, and its radial direction matches in the front-rear direction and the left-right direction. The drive shaft 782 extends in the up-down direction. The upper end of the drive shaft 782 is connected to the center of the bottom face of the wall portion 781. The drive shaft 782 is connected to a drive mechanism (not shown in the drawings) that includes a motor, a gear, and the like. The rotating of the drive shaft 782 by the operation of the drive mechanism rotates the wall portion 781.

The shaft portion 783 extends in the up-down direction. The lower end of the shaft portion 783 is connected to the outer circumferential portion of the top face of the wall portion 781. The shaft portion 783 is positioned to the outside of the rotational center of the drive shaft 782 and is inserted into the oblong hole 75. The wall portion 784 extends downward from the perimeter of the wall portion 781.

The wall portion 79 is provided below the wall portion 781 and the wall portion 784. The wall portion 79 is rectangular in a plan view and extends horizontally. The wall portion 79 is provided with a hole 791 that extends through the wall portion 79 in the up-down direction. The drive shaft 782 is inserted into the hole 791. A wall portion 792 is connected to the wall portion 79. The wall portion 792 is disposed along the inner face of the wall portion 784 in the front-rear direction and the left-right direction and is formed such that it extends upward. The hole 791 is positioned in the center of the wall portion 792 in the front-rear direction and the left-right direction.

As shown in FIGS. 3 to 5, a sloping face 80, which is a face that extends obliquely downward toward the left, is connected to the left edge of the wall portion 79. The lower edge of the sloping face 80 extends to an expeller outlet 81. The expeller outlet 81 is an outlet that expels the ink, and it is connected to a tank (not shown in the drawings) that stores the expelled ink.

The mechanism that moves the wiper portion 31 up and down between the withdrawn position and the contact position will be described with reference to FIGS. 3, 4, and 9. The movement of the wiper portion 31 up and down between the withdrawn position and the contact position is controlled by the CPU of the printer 1. As shown in FIG. 3, in a case where the wiper portion 31 is positioned in the withdrawn position, the shaft portion 783 and the movement portion 63 are positioned as far as possible to the right side. In a case where the wiper portion 31 moves from the withdrawn position to the contact position, the CPU operates the drive mechanism (not shown in the drawings) by only a specified amount. The wall portion 781 is thus rotated through the drive shaft 782 of the rotary member 78, and the shaft portion 783 moves in rotation around the drive shaft 782. In this case, as the shaft portion 783 slides within the oblong hole 75, it pushes the wall portion 74 toward the left. Thus, as shown in FIG. 9, the movement portion 63 moves to the left, and the sloping portions 641 move to the left.

The movement of the support member 32 in the left-right direction is restricted by the guide wall portions 801 (refer to FIG. 8). Therefore, in conjunction with the movements of the sloping portions 641, the wiper portion 31 moves upward along the sloping portions 641 against the energizing force of the coil spring 60, while the support member 32 is guided by the guide wall portions 801. At this time, the contact portions 671 are in contact with the top faces of the corresponding recessed portions 331 (refer to FIGS. 6 and 7). The engaging lugs 351 of the support member 32 slide in relation to the corresponding engagement portions 681. As shown in FIG. 4, when the drive mechanism has been operated by the specified amount and has stopped, the shaft portion 783 and the movement portion 63 are positioned as far as possible to the left, and the wiper portion 31 is positioned in the contact position.

In a case where the wiper portion 31 moves from the contact position to the withdrawn position, the CPU operates the drive mechanism by only a specified amount. The wall portion 781 is thus rotated through the drive shaft 782 of the rotary member 78, and the shaft portion 783 moves in rotation around the drive shaft 782. In this case, as the shaft portion 783 slides within the oblong hole 75, it pushes the wall portion 74 toward the right. The movement portion 63 thus moves to the right. Accordingly, the sloping portions 641 also move to the right. The movement of the support member 32 in the left-right direction is restricted by the guide wall portions 801. Therefore, in conjunction with the movements of the sloping portions 641, the wiper portion 31 moves downward along the sloping portions 641 in accordance with the energizing force of the coil spring 60, while the support member 32 is guided by the guide wall portions 801. At this time, the contact portions 671 are in contact with the top faces of the corresponding recessed portions 331. The engaging lugs 351 of the support member 32 slide in relation to the corresponding engagement portions 681. As shown in FIG. 4, when the drive mechanism has been operated by the specified amount and has stopped, the wiper portion 31 is positioned in the withdrawn position.

The maintenance operations will be explained with reference to FIGS. 3 to 5. For example, the maintenance operations include a flushing operation, an ink purge operation, a first wiping operation, a second wiping operation, and the like. The flushing operation is an operation in which, before printing is performed on the print medium, the head 110 discharges the inks onto the flushing receiving portion 145. The performing of the flushing operation makes it possible for the inks to be discharged appropriately from the head 110, even right after the printing starts. The ink purge operation is an operation in which the nozzle face 111 is capped by the nozzle cap 144 and the inks are sucked out of the nozzles by a suction device (not shown in the drawings) that is connected to the nozzle cap 144. The performing of the ink purge operation discharges from the nozzles, along with the ink, any air bubbles that have gotten inside the nozzles, so the possibility can be reduced that an ink discharge problem will be caused by the air bubbles.

The first wiping operation is an operation that uses wiper 51 to wipe off excess ink that is remaining on the surface of the nozzle face 111. The performing of the first wiping operation can reduce the possibility that the ink that is remaining on nozzle face 111 will harden and bind to the nozzle face 111, making it difficult to discharge the ink from the nozzle face 111. The second wiping operation is an operation in which ink that is adhering to the wiper 51 is wiped off by the absorption member 148. The performing of the second wiping operation can reduce the possibility that the ink that is remaining on the wiper 51 will be removed from the wiper 51 and adhere to the nozzle face 111 the next time that the first wiping operation is performed.

The first wiping operation and the second wiping operation will be explained with reference to FIG. 5. The CPU conducts the first wiping operation and the second wiping operation by controlling the printer 1 in accordance with a program that is stored in a storage portion (not shown in the drawings). By operating the drive mechanism by only the specified amount, the CPU moves the wiper portion 31 from the withdrawn position (refer to FIG. 3) to the contact position (refer to FIG. 4). The CPU operates the drive motor 19 (refer to FIG. 1) to move the head unit 100 (refer to FIG. 1) in the first direction. As shown in FIG. 5, the wiper 51 of the wiper portion 31, which is in the contact position, comes into contact with the nozzle face 111 and wipes off any excess ink that remains on the nozzle face 111. By operating the drive mechanism by only the specified amount, the CPU moves the wiper portion 31 from the contact position to the withdrawn position, then terminates the first wiping operation. Note that the head unit 100 may be moved reciprocally a plurality of times in relation to the wiper portion 31, and the ink may be wiped off a plurality of times.

The CPU conducts the second wiping operation after the first wiping operation is terminated. In this case, the CPU moves the movement portion 63 by operating the drive mechanism by only the specified amount and moves the wiper portion 31 to a position in the up-down direction (not shown in the drawings) where the wiper 51 is in contact with the absorption member 148. The CPU conducts the second wiping operation by moving the support plate 149 toward the right, causing the wiper 51 to slide along the bottom face of the absorption member 148.

As explained above, according to the present embodiment, the printer 1 is provided with the wiper 51, which includes the plurality of the holes 501, the plurality of the inserted members 391, which are inserted into the plurality of the holes 501 such that they can move, and the support member 32, which supports the wiper 51. Because the wiper 51 comes into contact with the nozzle face 111 of the head 110 when it wipes the ink off of the nozzle face 111 of the head 110, the wiper 51 bears a load from the nozzle face 111, due to the impact of the contact. The wiper 51 also bears a load from the restricting member 41, because it is maintained in an elastically deformed state by the plurality of the pressing pieces 401 that are provided on the restricting member 41.

The plurality of the inserted members 391 are inserted into the corresponding plurality of the holes 501 that are provided in the wiper 51, such that the wiper 51 is supported by the support member 32 and the plurality of the inserted members 391 can move in relation to the support member 32. Thus, in a case where the wiper 51 is subjected to an external force, the wiper 51 can deform and move in response to the external force. Therefore, the loads that the wiper 51 bears from the restricting member 41 and the nozzle face 111 can be dispersed. Accordingly, the printer 1 can lighten the load that bears directly on the wiper 51. The durability of the wiper 51 is therefore improved, so the ink can be reliably wiped off of the nozzle face 111 of the head 110. Thus the printer 1 can reduce maintenance problems with the head 110. Moreover, the plurality of the inserted members 391 are inserted into the plurality of the holes 501 in the wiper 51. Therefore, the wiper 51 does not rotate in relation to the support member 32, even if the wiper 51 is subject to an impact when the wiper 51 comes into contact with the nozzle face 111. Accordingly, the ink can be wiped off of the nozzle face 111 reliably.

The printer 1 is provided with the plurality of the pressing pieces 401 on the restricting member 41. Each one of the pressing pieces 401 is set apart from the neighboring pressing pieces 401, such that open slots are formed between the wiper 51 and the restricting member 41. When the wiper 51 wipes off the ink and the ink drips off of the wiper 51, the ink flows through the open slots, so the ink does not accumulate on the plurality of the pressing pieces 401. Therefore, the printer 1 can reduce the degree to which the ink hardens and binds to the wiper 51 and the plurality of the pressing pieces 401, even if the ink is of such a nature that its viscosity increases when it dries, causing it to harden and bind to a member to which it is adhering. The printer 1 is therefore able to ensure the movement of the wiper 51, so the loads that the wiper 51 bears from the restricting member 41 and the nozzle face 111 can be lightened.

Furthermore, if only one pressing piece presses on the wiper 51, a load would bear on the wiper 51 only in the one location where the pressing piece is pressing, creating the possibility that the wiper 51 would not be sufficiently deformed in a location that is distant from the location where the pressing piece is pressing. The printer 1 is provided with the plurality of the pressing pieces 401, which are able to press on the wiper 51 in a plurality of locations, so the wiper 51 can be pressed more reliably. In addition, there is no concern that a liquid that has accumulated on the pressing pieces 401 will be transferred to the wiper 51 and later return to the nozzle face 111, so the nozzle face 111 of the head 110 can be reliably wiped. Note that the liquid that is discharged from the nozzle face 111 is not limited to being an ink, and it may also be, for example, a discharge agent that decolorizes a dyed cloth, a processing agent that makes the ink adhere better to the cloth, or the like. Even in these sorts of cases, the nozzle face 111 of the head 110 can be reliably wiped, because there is no concern that a liquid that has accumulated on the pressing pieces 401 will be transferred to the wiper 51 and later return to the nozzle face 111.

The printer 1 is provided with the coil spring 60 and the protective member 55, which includes the top wall 551 that covers the coil spring 60 from the nozzle face 111 side. If the ink that has been wiped off by the wiper 51 adheres to the coil spring 60, for example, the energizing force of the coil spring 60 would be impaired by the hardening and bonding of the ink to the coil spring 60 when the ink dries. In that case, the moving of the wiper portion 31 from the withdrawn position to the contact position by the movement portion 63 would not be performed smoothly, so the ink would not be sufficiently wiped off of the nozzle face 111 of the head 110 by the wiper 51. According to the printer 1, the ink that has been wiped off by the wiper 51 flows downward from the openings between the plurality of the pressing pieces 401 and through the open slots between the wiper 51 and the restricting member 41. The ink then falls onto the top wall 551 of the protective member 55, so the protective member 55 can reduce the adhering of the ink to the coil spring 60. The printer 1 is therefore able to perform the maintenance operations adequately, without impairing the energizing force of the coil spring 60.

The edge on the third direction side of the first wall portion 42 slopes in the third direction from the center of the first wall portion 42 in the second direction toward the ends of the first wall portion 42 in the second direction. Thus, when the ink that has been wiped off by the wiper 51 drips in the third direction onto the restricting member 41, the ink falls off from the ends in the second direction of the first wall portion 42. Furthermore, the coil spring 60 is provided closer to the center in the second direction of the restricting member 41 than the ends in the second direction of the restricting member 41. Therefore, the printer 1 is able to reduce the adhering to the coil spring 60 of the ink that has fallen from the first wall portion 42 of the restricting member 41.

The protective member 55 is provided with the second wall portion 553, which is provided on the first direction side of the coil spring 60 and extends in the third direction from the top wall 551. The second wall portion 553 is able to prevent the ink that has been wiped off by the wiper 51 from adhering to the coil spring 60. Furthermore, the second wall portion 553 is provided with the pair of the slots 554 on the third direction edge of the second wall portion 553, slightly inside from the second direction ends of the second wall portion 553. The slots 554 extend in the opposite direction from the third direction (that is, upward). If the third direction edge of the second wall portion 553 was flat, the ink that has been wiped off by the wiper 51 would spread along the third direction edge of the second wall portion 553 and flow toward the center. The coil spring 60 is disposed below the restricting member 41, closer to the center than both ends of the restricting member 41, so to the extent that the ink has flowed toward the center, for example, the ink might adhere to the coil spring 60 when the ink falls from the third direction edge of the second wall portion 553. In the printer 1, the slots 554 that are provided in the second wall portion 553 cut off the flow toward the center of any liquid that has been wiped off by the wiper 51. The printer 1 is therefore able to reduce the flow of the ink that has been wiped off by the wiper 51 toward the center along the third direction edge of the second wall portion 553.

The restricting member 41 and the support member 32 are fixed in place by the lugs 311 that are respectively inserted into the round hole 43 and the oblong hole 44, by the screw 600 that is inserted through the anchoring hole 45 and screwed into the threaded anchoring hole 33, and by the engaging portions 411 that engage with the engaged portions 321. Where the restricting member 41 is warped, or where the restricting member 41 is rotated in relation to the support member 32, for example, the plurality of the pressing pieces 401 may not be uniformly in contact with the wiper 51. In that case, localized loads would bear on the wiper 51 and possibly damage the wiper 51.

In a case where the wiper 51 is subjected to an external force, the load that results from the external force to which the wiper 51 is subjected is dispersed toward the restricting member 41. The engaging portions 411 that are engaged with the engaged portions 321 are able to utilize the load that the wiper 51 disperses toward the restricting member 41 in order to reduce the warping of the restricting member 41. The ribs 46 are able to reduce the warping of the restricting member 41 by reinforcing the first wall portion 42 and increasing its rigidity. The lugs 311 that are respectively inserted into the round hole 43 and the oblong hole 44 are able to reduce the rotation of the restricting member 41 in relation to the support member 32. Furthermore, because one of the round hole 43 and the oblong hole 44 (in the present embodiment, the oblong hole 44) is an oblong hole whose long axis extends in the front-rear direction, the restricting member 41 can easily be joined to the support member 32.

The present disclosure is not limited to the embodiment that is described above, and various types of modifications can be made. For example, in the embodiment that is described above, the printer 1 is provided with the restricting member 41 on the opposite side of the wiper 51 from the first direction, but the restricting member 41 may also be provided on the first direction side of the wiper 51. In that case, the pressing pieces 401 would press against the wiper 51 in the opposite direction from the first direction.

In the printer 1, the plurality of the pressing pieces 401 are disposed such that they are set apart from one another, but it is only necessary to provide at least one of the pressing pieces 401. The plurality of the pressing pieces 401 may also be provided such that they are not set apart from one another. For example, the printer 1 may also be provided with a pressing piece that is wave-shaped in a plan view.

The support configuration of the wiper 51 to the support member 32 is not limited to the support configuration in the present embodiment, and the wiper 51 may also be supported without the recessed portion 131 being formed in the support member 32, for example. In the printer 1, the protective member 55 is provided on the lower edge of the support member 32, but the present disclosure is not limited to this configuration, and the protective member 55 needs only to be provided above the coil spring 60. Furthermore, in the printer 1, the protective member 55 is provided on the support member 32, but the present disclosure is not limited to this configuration, and the protective member 55 may also be provided on the restricting member 41, for example.

The printer 1 is provided with the coil spring 60, the movement portion 63, and the protective member 55, but it is also acceptable for the coil spring 60, the movement portion 63, and the protective member 55 not to be provided. For example, it is sufficient for the head 110 to move to a position where the wiper 51 and the nozzle face 111 of the head 110 come into contact only in a case where the wiper 51 will wipe the ink off of the nozzle face 111. In that case, in the printer 1, the third direction edge of the first wall portion 42 would be formed such that it slopes from the center of the edge in the second direction toward the ends of the edge in the second direction, such that the ends of the edge in the second direction are positioned lower than the center of the third direction edge in the second direction. However, it is also acceptable for the third direction edge of the first wall portion 42 not to be formed such that it slopes.

The plurality of the inserted members 391 are provided on the support member 32. However, the plurality of the inserted members 391 are not necessary to be provided on the support member 32, as long as they extend in the first direction. For example, the plurality of the inserted members 391 may also be provided on the face of the restricting member 41 that faces the wiper 51, in positions that correspond to the holes 501 in the wiper 51. Furthermore, the positions where the inserted members 391 are provided on the support member 32 are not limited to the positions in the present embodiment. The inserted members 391 need only to be disposed between the support member 32 and the restricting member 41, and it is not necessary to be provided close to the upper edge of the support member 32. For example, the inserted members 391 may also be provided in a central portion of the up-down direction of the support member 32, and they may also be provided close to the lower edge of the support member 32. Furthermore, the printer 1 is provided with the three holes 501, but it is necessary only for a plurality of the holes 501 to be provided. Therefore, the number of the holes 501 is not limited to being three. The printer 1 is provided with the three inserted members 391, but it is necessary only for a plurality of the inserted members 391 to be provided. Therefore, the number of the inserted members 391 is not limited to being three.

The coil spring 60 is not limited to being a coil spring, and it may also be a synthetic resin that has elasticity, such as a rubber or the like, for example. The coil spring 60 may also be connected to the support member 32 in one location. The liquid that is discharged from the nozzle face 111 is not limited to being an ink. The liquid may also be a discharge agent that decolorizes a dyed cloth, for example.

The printing process of the printer 1 for printing on the print medium is not limited to the printing process described above, in which the head 110 moves horizontally. For example, the platen may also move in the front-rear direction and the left-right direction, without any movement by a head. The head and the platen may also both move in the front-rear direction and the left-right direction. In other words, the head may also move in the front-rear direction and the left-right direction in relation to the print medium.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A print device comprising:

a head portion including a nozzle face, the nozzle face having a nozzle, the nozzle being provided to discharge a liquid onto a print medium, and the head portion being able to move in relation to the print medium in at least a first direction among parallel directions to the nozzle face;

a wiper being a plate-shaped elastic body and extending in a second direction, the second direction being orthogonal to the first direction and parallel to the nozzle face, the wiper including a plurality of holes, the plurality of holes extending through the wiper in the first direction, and the wiper including a wiper edge portion, the wiper edge portion being opposed to the nozzle face and provided on an edge portion of the wiper to wipe the nozzle face;

a first wall portion provided on the opposite side of the wiper from the first direction side and provided on a third direction from the wiper edge portion, the third direction being a direction from the nozzle face toward the wiper of orthogonal directions in relation to the nozzle face;

at least one pressing piece provided in the first wall portion and extending toward the wiper, the at least one pressing piece pressing against the wiper at a position in the third direction from the wiper edge portion to maintain the wiper in a state of elastic deformation;

a support member provided on the first direction side of the wiper and supporting the wiper; and a plurality of inserted members provided on the third direction from the at least one pressing piece and extending in the first direction between the support member and the first wall portion, and the plurality of the inserted members being inserted into the plurality of the holes respectively.

2. The print device according to claim 1, wherein the at least one pressing piece is a plurality of the pressing piece, and the plurality of the pressing piece are arrayed in the second direction, with neighboring ones of the plurality of the pressing pieces being set apart from one another.

3. The print device according to claim 2, further comprising:

an energizing member provided on the third direction side from the plurality of the pressing pieces and energizing the support member in the third direction;

a top wall extending in the first direction between the plurality of the pressing pieces and the energizing member to cover the energizing member from the nozzle face side, the top wall sloping in the third direction from a central portion in the second direction of the top wall toward both ends in the second direction of the top wall.

4. The print device according to claim 3, wherein the energizing member is provided closer to the center in the second direction of the support member than the ends of the support member in the second direction, and an edge portion on the third direction side of the first wall portion slopes in the third direction from a central portion in the second direction of the first wall portion toward both ends in the second direction of the first wall portion.

5. The print device according to claim 3, further comprising:

a second wall portion provided on the first direction side of the energizing member and extending in the third direction from the top wall, the second wall portion including slots at both ends in the second direction of the third direction edge of the second wall portion, the slots extending in the opposite direction from the third direction.

6. The print device according to claim 3, wherein the at least one pressing piece extends in the first direction from the first wall portion and pushes the wiper.

7. The print device according to claim 3, wherein the plurality of the inserted members are provided in the support member.

8. The print device according to claim 3, wherein the top wall is provided on the third direction side from the at least one pressing piece.

9. The print device according to claim 3, wherein the first wall portion and the support member include a plurality of anchoring holes and a plurality of anchoring members to be respectively inserted into the plurality of anchoring holes.

10. The print device according to claim 3, wherein the plurality of anchoring holes include at least one oblong hole.

11. The print device according to claim 3, wherein the plurality of the anchoring members respectively inserted into the plurality of anchoring holes are provided on the third direction side from the wiper.

* * * * *